US006558579B2

(12) United States Patent
Handa et al.

(10) Patent No.: US 6,558,579 B2
(45) **Date of Patent: *May 6, 2003**

(54) ORGANIC POSITIVE TEMPERATURE COEFFICIENT THERMISTOR AND MAKING METHOD

(75) Inventors: Tokuhiko Handa, Tokyo (JP); Yukie Yoshinari, Tokyo (JP)

(73) Assignee: TDK Corporation, Tokyo (JP)

( * ) Notice: Subject to any disclaimer, the term of this patent is extended or adjusted under 35 U.S.C. 154(b) by 71 days.

This patent is subject to a terminal disclaimer.

(21) Appl. No.: 09/825,828

(22) Filed: Apr. 5, 2001

(65) Prior Publication Data

US 2002/0145130 A1 Oct. 10, 2002

(51) Int. Cl.[7] ..... H01B 1/00

(52) U.S. Cl. ..... 252/511; 252/500; 252/510; 252/512; 252/513; 252/518.1; 219/541; 219/546; 219/547; 219/553; 264/104; 264/105; 264/234; 264/347

(58) Field of Search ..... 252/500, 510, 252/511, 512, 513, 518.1; 219/541, 546, 547, 553; 264/105, 104, 234, 347

(56) References Cited

U.S. PATENT DOCUMENTS

| | | | |
|---|---|---|---|
| 3,243,753 | A | 3/1966 | Kohler |
| 3,351,882 | A | 11/1967 | Kohler et al. |
| 5,378,407 | A | 1/1995 | Chandler et al. |
| 5,945,034 | A | 8/1999 | Handa |
| 6,143,206 | A | 11/2000 | Handa et al. |

FOREIGN PATENT DOCUMENTS

| | | |
|---|---|---|
| JP | 5-47503 | 2/1993 |

*Primary Examiner*—Yogendra N. Gupta
*Assistant Examiner*—Derrick G. Hamlin
(74) *Attorney, Agent, or Firm*—Oblon, Spivak, McClelland, Maier & Neustadt, P.C.

(57) ABSTRACT

The invention aims to provide an organic PTC thermistor having a lower operating temperature than prior art organic PTC thermistors and exhibiting improved characteristics. The object is attained by an organic PTC thermistor comprising a polymer synthesized in the presence of a metallocene catalyst and conductive particles having spiky protuberances.

5 Claims, 2 Drawing Sheets

ORGANIC POSITIVE TEMPERATURE COEFFICIENT THERMISTOR AND MAKING METHOD

BACKGROUND OF THE INVENTION

1. Field of the Invention

This invention relates to an organic positive temperature coefficient thermistor that is used as a temperature sensor or overcurrent-protecting element, and has positive temperature coefficient (PTC) of resistivity characteristics that its resistance value increases with increasing temperature.

2. Background Art

An organic positive temperature coefficient thermistor having conductive particles dispersed in a crystalline thermoplastic polymer is well known in the art, as disclosed in U.S. Pat. Nos. 3,243,753 and 3,351,882. The increase in the resistance value is believed to be due to the expansion of the crystalline polymer upon melting, which in turn cleaves a current-carrying path formed by the conductive fine particles.

An organic positive temperature coefficient thermistor can be used as a self-regulating heater, an overcurrent-protecting element, and a temperature sensor. Requirements for these are that the resistance value is sufficiently low at room temperature in a non-operating state, the rate of change between the room-temperature resistance value and the resistance value in operation is sufficiently large, and the resistance value change upon repetitive operations is reduced.

The crystalline thermoplastic polymers used thus far include polyolefins such as polyethylene and polypropylene, polyolefin copolymers of ethylene with various comonomers (e.g., ethylene-vinyl acetate copolymers and ethylenemethacrylic acid copolymers), and fluorine polymers such as polyvinylidene fluoride. Of these, high-density polyethylenes having high crystallinity are often used. The reason is that higher crystallinity polymers have a greater coefficient of expansion and a greater change rate of resistance whereas lower crystallinity polymers have a lower crystallization speed so that when cooled from the fused state, they fail to resume the original crystalline state and exhibit a large change of resistance at room temperature.

One drawback to use of high-density polyethylene is its high operating temperature. The thermistor for use as an overcurrent-protecting element has an operating temperature approximate to its melting point of 130° C., which can have a non-negligible thermal influence on other electronic parts on the circuit board. For use as a heat protecting element for a secondary battery, the operating temperature is too high as well. There is a need for a protective element capable of operation at a lower temperature.

Methods for lowering the melting point of polyolefin in order to lower the operating temperature include modifying polyolefin to a structure having many side chains like low-density polyethylene for thereby lowering the density, and introducing comonomers to form copolymers (polyolefin copolymers as mentioned above) for thereby lowering the melting point. Either of these methods, however, results in a polymer with a lower crystallinity, which fails to provide a sufficient resistance change rate or requires a longer time for crystallization. Thus the ability to resume room-temperature resistance upon cooling after operation is substantially impaired.

SUMMARY OF THE INVENTION

An object of the invention is to provide an organic positive temperature coefficient thermistor having a lower operating temperature than prior art organic positive temperature coefficient thermistors and exhibiting improved characteristics, and a method for preparing the same.

The inventors have found that the above drawback can be overcome by using a polymer, especially a linear low-density polyethylene (LLDPE), synthesized in the presence of a metallocene catalyst. Specifically, the operating temperature is lowered to about 100° C. which is lower than that of high-density polyethylene, while a good resistance resuming ability is maintained. This is accomplished partially because the polymer resulting from polymerization in the presence of a metallocene catalyst has a narrow molecular weight distribution with a reduced content of a low-density, low-molecular weight fraction. Furthermore, prior art LLDPE contains a high-density fraction which crystallizes and serves as crystal nuclei to promote crystallization, whereas the use of a metallocene catalyst ensures uniform creation and growth of crystal nuclei so that even when the polyethylene is melted during operation, the subsequent change of performance is minimized.

According to the invention, conductive particles having spiky protuberances are used in combination, accomplishing both a low room-temperature resistance and a large resistance change rate.

JP-A 5-47503 discloses an organic PTC thermistor comprising a crystalline polymer and conductive particles having spiky protuberances. Also, U.S. Pat. No. 5,378,407 discloses a conductive polymer composition comprising filamentary nickel powder having spiky protuberances, and a polyolefin, olefin copolymer or fluoropolymer. These patent references teach nowhere use of the polymer synthesized in the presence of a metallocene catalyst.

Also, a low-molecular weight organic compound may be further admixed where it is necessary to further lower the operating temperature. In JP-A 11-168005, the inventors proposed an organic PTC thermistor comprising a thermoplastic polymer matrix, a low-molecular weight organic compound, and conductive particles having spiky protuberances. This thermistor has a low room-temperature resistance and a high resistance change rate as well as a lower operating temperature than prior art thermistors using high-density polyethylene matrix. The low-molecular weight organic compound used as an operating substance does not assume the super-cooled state as do polymers, offering a possibility that the transition temperature at which resistance increases upon heating be substantially equal to the temperature at which low resistance is resumed upon cooling.

Where the thermoplastic polymer matrix used in the above-referred patent publication is a low-density polyethylene, the temperature at which the thermistor changes its resistance from high back to low when it cools down after operation is approximately equal to the temperature (operating temperature) at which the thermistor changes its resistance from low to high upon heating (a reduced resistance vs. temperature curve hysteresis). There scarcely occurs the negative temperature coefficient (NTC) of resistivity phenomenon that the resistance decreases after it has once increased. However, the low-density polyethylene has the drawback of a poor ability to resume resistance before and after operation due to its low crystallinity, as previously described.

On the other hand, where the thermoplastic polymer matrix used in the above-referred patent publication is a high-density polyethylene, the ability to resume resistance is good, but there occurs the NTC phenomenon that the resistance decreases after it has once increased during operation at the melting point of the low-molecular weight organic compound, and the temperature at which the thermistor changes its resistance from high back to low when it cools down after operation is higher than the temperature at which the thermistor changes its resistance from low to high upon heating (an increased R-T curve hysteresis).

These problems occur probably because when the low-molecular weight organic compound is melted, its low melt viscosity allows for easy rearrangement of conductive particles so that the resistance decreases after operation or the resistance decreases even at a temperature above the melting point. Where the low-density polyethylene is used as the matrix, its melting point is lower than that of the high-density polyethylene so that when the low-molecular weight organic compound is melted, part of the low-density polyethylene as the matrix is also melted to increase the viscosity of the entire molten components.

This restrains rearrangement of conductive particles, which is the reason why the hysteresis is small and no NTC phenomenon occurs. The NTC phenomenon can trigger the thermal runaway of the thermistor during operation. The increased hysteresis of the latter becomes a problem when the thermistor is used as a temperature sensor such as a heat protecting element. Using a polymer synthesized in the presence of a metallocene catalyst as the matrix, the present invention succeeds in providing an organic PTC thermistor having minimized NTC phenomenon and R-T curve hysteresis and a good ability to resume resistance.

These and other objects are attained by the present invention defined below.

(1) An organic positive temperature coefficient thermistor comprising a polymer synthesized in the presence of a metallocene catalyst and conductive particles having spiky protuberances.

(2) The organic positive temperature coefficient thermistor of (1), wherein said polymer synthesized in the presence of a metallocene catalyst is a linear low-density polyethylene.

(3) The organic positive temperature coefficient thermistor of (1), wherein said conductive particles having spiky protuberances are interconnected in chain-like network.

(4) The organic positive temperature coefficient thermistor of (1), further comprising a low molecular weight organic compound.

(5) A method for preparing an organic positive temperature coefficient thermistor, comprising the steps of synthesizing a polymer in the presence of a metallocene catalyst, admixing the polymer with conductive particles having spiky protuberances, and treating the mixture with a silane coupling agent.

FUNCTION

The organic PTC thermistor of the invention is characterized by comprising a polymer synthesized in the presence of a metallocene catalyst and conductive particles having spiky protuberances.

According to the invention, conductive particles having spiky protuberances are used. The spiky shape of protuberances enables a tunnel current to pass readily through the thermistor, and makes it possible to obtain a room temperature resistance lower than would be possible with spherical conductive particles. A greater spacing between protuberant particles than between spherical particles allows for a large resistance change during operation of the thermistor.

The invention also uses a polymer synthesized in the presence of a metallocene catalyst, enabling to lower the operating temperature as compared with prior art organic PTC thermistors. There is obtained a thermistor having improved performance stability despite the low operating temperature, which is difficult to achieve in the prior art. The invention allows a low molecular weight organic compound to be admixed, helping to further lower the operating temperature. The performance stability is improved.

DESCRIPTION OF THE PREFERRED EMBODIMENTS

Figure 1:
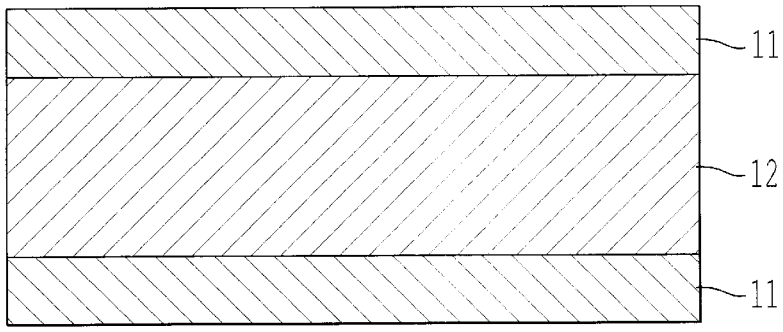
FIG. 1 is a schematic cross-section of an organic PTC thermistor.

The organic PTC thermistor of the invention includes a polymer synthesized in the presence of a metallocene catalyst and conductive particles having spiky protuberances.

The polymer used herein is synthesized in the presence of a metallocene catalyst, that is, a catalyst based on a metallocene of an organometallic compound. The metallocene catalyst used herein is a bis(cyclopentadienyl) metal complex catalyst belonging to the class of sandwich molecules.

In general, the metallocene catalysts include (a) metallocene catalyst components consisting of transition metal compounds of Group IVB, VB and VIB in the Periodic Table having at least one ligand having a cyclopentadienyl skeleton, (b) organoaluminum oxy compound catalyst components, (c) microparticulate carriers, and optionally, (d) organoaluminum compound catalyst components and (e) ionized ionic compound catalyst components.

The preferred metallocene catalyst components (a) used herein are transition metal compounds of Group IVB, VB and VIB in the Periodic Table having at least one ligand having a cyclopentadienyl skeleton. The transition metal compounds are, for example, those of the following general formula [I].

$$ML1_x \qquad [I]$$

Herein, x is the valence of a transition metal atom M. M is a transition metal atom, preferably selected from Group IV in the Periodic Table, for example, zirconium, titanium, and hafnium, and most preferably, zirconium and titanium.

L1 stands for ligands which coordinate to the transition metal atom M. Of these, at least one ligand L1 is a ligand having a cyclopentadienyl skeleton. Examples of the ligand L1 having a cyclopentadienyl skeleton that coordinates to the transition metal atom M include alkyl-substituted cyclopentadienyl groups such as cyclopentadienyl, as well as indenyl, 4,5,6,7-tetrahydroindenyl, and fluorenyl groups. These groups may be replaced by halogen atoms, trialkylsilyl groups or the like.

Where the compound of the above general formula [I] contains two or more groups having a cyclopentadienyl skeleton, two of these groups having a cyclopentadienyl skeleton may be bound through an alkylene group such as ethylene or propylene, a silylene group or a substituted silylene group such as dimethylsilylene, diphenylsilylene or methylphenylsilylene.

Preferred as the organoaluminum oxy compound catalyst components (b) are aluminooxanes. Examples are those having about 3 to 50 recurring units represented by the formula: —Al(R)O— wherein R is an alkyl, such as methyl aluminooxane, ethyl aluminooxane and methyl ethyl aluminooxane. Not only chain-like compounds, but cyclic compounds are also employable.

The microparticulate carriers (c) used in the preparation of olefin polymerization catalysts are granular or microparticulate solids of inorganic or organic compounds having a particle diameter of usually about 10 to 300 $\mu$m, preferably about 20 to 200 $\mu$m.

Preferred inorganic carriers are porous oxides, for example, $SiO_2$, $Al_2O_3$, MgO, $ZrO_2$, and $TiO_2$. The organoaluminum compound catalyst components (d) used in the preparation of olefin polymerization catalysts are exemplified by trialkylaluminums such as trimethylaluminum, dialkylaluminum halides such as dimethylaluminum chloride, and alkylaluminum sesquihalides such as methylaluminum sesquichloride.

The ionized ionic compound catalyst components (e) include, for example, Lewis acids such as triphenylboron, $MgCl_2$, $Al_2O_3$, and $SiO_2$—$Al_2O_3$ as described in U.S. Pat. No. 5,321,106; ionic compounds such as triphenylcarbonium tetrakis(pentafluorophenyl)borate; and carborane compounds such as dodecarborane and bis-n-butylammonium (1-carbododeca)borate.

The polymer used herein can be obtained by polymerizing a starting material in the presence of the above-described catalyst in a vapor phase or a liquid phase in slurry or solution form under various conditions.

Included are ethylene polymers (e.g., homopolymers of ethylene, copolymers of ethylene with α-olefins having about 4 to about 20 carbon atoms or cyclic olefins, homopolymers of propylene, and copolymers of propylene with α-olefins) and styrene polymers. Of these, ethylene polymers are preferred, and linear low-density polyethylenes (LLDPE) which are copolymers of ethylene with α-olefins are especially preferred.

The linear low-density polyethylenes are preferably obtained by copolymerizing ethylene with α-olefins having 4 to 20 carbon atoms.

Examples of the α-olefins having 4 to 20 carbon atoms used in copolymerization with ethylene include propylene, 1-butene, 1-pentene, 1-hexene, 4-methyl-1-pentene, 1-octene, 1-decene, and 1-dodecene. Of these, α-olefins having 4 to 10 carbon atoms, especially α-olefins having 4 to 8 carbon atoms are preferred.

Such α-olefins may be used alone or in admixture of two or more. It is desirable that the linear low-density polyethylenes used herein contain from 50% to less than 100% by weight, preferably 75 to 99% by weight, more preferably 80 to 95% by weight, most preferably 85 to 95% by weight of constituent units derived from ethylene and up to 50% by weight, preferably 1 to 25% by weight, more preferably 5 to 20% by weight, most preferably 5 to 15% by weight of constituent units derived from α-olefins having 3 to 20 carbon atoms.

The linear low-density polyethylenes used herein preferably have a density in the range of 0.900 to 0.940 g/cm$^3$, and more preferably 0.910 to 0.930 g/cm$^3$.

Also, the linear low-density polyethylenes used herein preferably have a melt flow rate (MFR, ASTM D1238, 190° C., load 2.16 kg) in the range of 0.05 to 20 g/10 min, and more preferably 0.1 to 10 g/10 min.

As previously described, the linear low-density polyethylenes used herein should preferably have a narrow molecular weight distribution, and the Mw/Mn as an index of molecular weight distribution is preferably up to 6, more preferably up to 4. Mw is a weight average molecular weight and Mn is a number average molecular weight, both measured by gel permeation chromatography (GPC).

The number of long-chain branches on the linear low-density polyethylenes used herein is preferably up to 5 carbons per 1000 backbone carbons and more preferably up to 1 carbon per 1000 backbone carbons. The number of long-chain branches is measured by $^{13}$C-NMR.

In the practice of the invention, another polymer may be admixed with the polymer synthesized in the presence of a metallocene catalyst. The other polymer is preferably a thermoplastic polymer and is preferably admixed in an amount of up to 25% based on the weight of the polymer synthesized in the presence of a metallocene catalyst.

Illustrative examples of the other polymer include polyolefins (e.g., polyethylene, polypropylene, ethylenevinyl acetate copolymers, polyalkyl acrylates such as polyethyl acrylate, and polyalkyl (meth)acrylates such as polymethyl (meth)acrylate, which are polymerized in the absence of a metallocene catalyst), fluoropolymers (e.g., polyvinylidene fluoride, polytetrafluoroethylene, polyhexafluoropropylene, and copolymers thereof), chlorinated polymers (e.g., polyvinyl chloride, polyvinylidene chloride, chlorinated polyvinyl chloride, chlorinated polyethylene, chlorinated polypropylene, and copolymers thereof), polyalkylene oxides (e.g., polyethylene oxide, polypropylene oxide, and copolymers thereof), polystyrene, polyamides, polycarbonates, polyethylene terephthalate, and thermoplastic elastomers.

The conductive particles having spiky protuberances as used herein are made up of primary particles each having pointed protuberances. More specifically, one particle bears a plurality of, usually 10 to 500, conical and spiky protuberances having a height of ⅓ to 1/50 of the particle diameter. The conductive particles are preferably made of a metal, typically nickel.

Although the conductive particles may be used in a powder form consisting of discrete particles, it is preferable that about 10 to 1,000 primary particles be interconnected in chain-like network to form a secondary particle. The chain form of particles does not exclude the partial presence of discrete primary particles. Examples of the former include a powder of spherical nickel particles having spiky protuberances, which is commercially available under the trade name of INCO Type 123 Nickel Powder (INCO Ltd.). The powder preferably has an average particle diameter of about 3 to 7 $\mu$m, an apparent density of about 1.8 to 2.7 g/cm$^3$, and a specific surface area of about 0.34 to 0.44 m$^2$/g.

Preferred examples of the chain-like network nickel powder are filamentary nickel powders, which are commercially available under the trade name of INCO Type 210, 255, 270 and 287 Nickel Powders from INCO Ltd. Of these, INCO Type 210 and 255 Nickel Powders are preferred. The primary particles therein preferably have an average particle diameter of preferably at least 0.1 $\mu$m, and more preferably from about 0.2 to about 4.0 $\mu$m. Most preferred are primary particles having an average particle diameter of 0.4 to 3.0 $\mu$m, in which may be mixed less than 50% by weight of primary particles having an average particle diameter of 0.1 $\mu$m to less than 0.4 $\mu$m. The amount of the conductive particles blended should preferably be 1.5 to 5 times, especially 2.5 to 4.5 times as large as the weight of the polymer or the total weight of the polymer and the low-molecular organic compound to be described later. Less amounts may be difficult to make the room-temperature resistance in a non-operating state sufficiently low whereas with larger amounts, it may become difficult to obtain a large change in resistivity during operation and to achieve uniform dispersion, failing to provide stable properties. The apparent density is about 0.3 to 1.0 g/cm$^3$ and the specific surface area is about 0.4 to 2.5 m$^2$/g.

It is to be noted that the average particle diameter is measured by the Fischer sub-sieve method.

Such conductive particles are set forth in JP-A 5-47503 and U.S. Pat. No. 5,378,407.

The invention favors to use a low-molecular weight organic compound in addition to the above-described polymer. The addition of the low-molecular weight organic compound affords a sharper resistance change with a temperature change and easier adjustment of operating temperature than with the polymer alone.

The low-molecular weight organic compound used herein is not critical as long as it is a crystalline substance having a molecular weight of less than about 4,000, preferably less than about 1,000, and more preferably about 200 to 800. Preferably it is solid at room temperature (about 25° C.). Its melting point preferably falls in the range of 40 to 100° C.

Such low-molecular weight organic compounds, for instance, include hydrocarbons (e.g., alkane series straight-chain hydrocarbons having 22 or more carbon atoms), fatty acids (e.g., fatty acids of alkane series straight-chain hydrocarbons having 12 or more carbon atoms), fatty esters (e.g., methyl esters of saturated fatty acids obtained from saturated fatty acids having 20 or more carbon atoms and lower alcohols such as methyl alcohol), fatty amides (e.g., unsaturated fatty amides such as oleic amide and erucic amide), aliphatic amines (e.g., aliphatic primary amines having 16 or more carbon atoms), and higher alcohols (e.g., n-alkyl alcohols having 16 or more carbon atoms). These compounds may be used alone or in admixture.

The low-molecular weight organic compound may be selected as appropriate to help disperse the other ingredients uniformly in the polymer while taking into account the nature of the polymer. The preferred low-molecular weight organic compounds are fatty acids.

These low-molecular weight organic compounds are commercially available, and commercial products may be used as such.

Since the invention is intended to provide a thermistor that can operate preferably up to 200° C., more preferably up to 100° C., the low-molecular weight organic compound used herein should preferably have a melting point (mp) of 40 to 200° C., more preferably 40 to 100° C. Such low-molecular weight organic compounds, for instance, include hydrocarbons, for example, paraffin wax under the trade name HNP-10 (mp 75° C.) from Nippon Seiro Co., Ltd.; fatty acids, for example, behenic acid (mp 81° C.), stearic acid (mp 72° C.) and palmitic acid (mp 64° C.), all from Nippon Seika Co., Ltd.; fatty esters, for example, methyl arachidate (mp 48° C.) from Tokyo Kasei Co., Ltd.; and fatty amides, for example, oleic amide (mp 76° C.) from Nippon Seika Co., Ltd. Also included are polyethylene waxes such as Mitsui Hiwax 110 (mp 100° C.) from Mitsui Chemical Co., Ltd.; stearic amide (mp 109° C.), behenic amide (mp 111° C.), N,N'-ethylenebislauric amide (mp 157° C.), N,N'-dioleyladipic amide (mp 119° C.), and N,N'-hexamethylenebis-12-hydroxystearic amide (mp 140° C.). Use may also be made of wax blends of a paraffin wax with a resin and such wax blends having microcrystalline wax further blended therein so as to give a melting point of 40° C. to 200° C.

The low-molecular weight organic compounds may be used alone or in combination of two or more, depending on the operating temperature and other factors.

An appropriate amount of the low-molecular weight organic compound is 0.2 to 4 times, preferably 0.2 to 2.5 times the total weight of the polymer. If this mixing proportion becomes lower or the content of the low-molecular weight organic compound becomes low, it may fail to provide a satisfactory resistance change rate. Inversely, if this mixing proportion becomes higher or the content of the low-molecular weight organic compound becomes high, the thermistor element can be deformed upon melting of the low-molecular weight organic compound and it may become awkward to mix with conductive particles.

It is acceptable to add auxiliary conductive particles capable of imparting electric conductivity, for example, carbonaceous conductive particles such as carbon black, graphite, carbon fibers, metallized carbon black, graphitized carbon black and metallized carbon fibers, spherical, flaky or fibrous metal particles, metal particles coated with a different metal (e.g., silver-coated nickel particles), and ceramic conductive particles such as tungsten carbide, titanium nitride, zirconium nitride, titanium carbide, titanium boride and molybdenum silicide, as well as conductive potassium titanate whiskers as disclosed in JP-A 8-31554 and JP-A 9-27383. The amount of auxiliary conductive particles should preferably be up to 25% by weight based on the weight of the conductive particles having spiky protuberances.

The amount of the conductive particles should preferably be 1.5 to 5 times as large as the total weight of the polymer synthesized in the presence of a metallocene catalyst and low-molecular organic compound (the total weight of organic components inclusive of curing agent and other additives). If this mixing ratio becomes low or the amount of the conductive particles becomes small, it may be difficult to make the room-temperature resistance in a non-operating state sufficiently low. If the amount of the conductive particles becomes large, on the contrary, it may become difficult to obtain a high rate of resistance change and to achieve uniform mixing, failing to provide stable properties.

It is now described how to prepare the organic PTC thermistor of the invention.

First, predetermined amounts of the polymer, optional low-molecular weight organic compound, and conductive particles having spiky protuberances are mixed and dispersed.

Any well-known method may be used for mixing and dispersion. Milling may be done in a mill or the like for about 5 to about 90 minutes at a temperature which is higher, preferably about 5 to 40° C. higher than the melting point of the polymer used. Where the low-molecular weight organic compound is used, it is acceptable to previously melt and mix the polymer and the low-molecular weight organic compound, or to dissolve and mix them in a solvent. There may be employed a variety of agitators, dispersing machines, mills and paint roll mills. If air is introduced during the mixing step, the mixture is vacuum deaerated. Various solvents such as aromatic hydrocarbons, ketones, and alcohols may be used for viscosity adjustment.

The milled mixture may be subjected to crosslinking treatment if desired. Possible crosslinking methods include chemical crosslinking with organic peroxides, crosslinking by exposure to radiation, and silane crosslinking including grafting silane coupling agents to effect condensation reaction of silanol groups in the presence of water. Of these methods, the crosslinking by exposure to radiation, especially electron beams, is preferred since it entails a relatively simple manufacturing step and enables dry process treatment despite a need for a certain installation investment.

To prevent thermal degradation of the polymer and low-molecular organic compound, an antioxidant may also be incorporated. Typically phenols, organic sulfurs, and phosphites are used as the antioxidant.

The milled mixture is press molded into a sheet having a predetermined thickness. Electrodes are formed on the sheet by heat pressing metal electrodes of Cu or Ni or applying a conductive paste.

The resulting sheet is punched into a desired shape, obtaining a thermistor device.

Additionally, there may be added a good thermal conductive additive, for example, silicon nitride, silica, alumina and clay (mica, talc, etc.) as described in JP-A 57-12061, silicon, silicon carbide, silicon nitride, beryllia and selenium as described in JP-B 7-77161, inorganic nitrides and magnesium oxide as described in JP-A 5-217711.

For durability improvements, there may be added titanium oxide, iron oxide, zinc oxide, silica, magnesium oxide, alumina, chromium oxide, barium sulfate, calcium carbonate, calcium hydroxide and lead oxide as described in JP-A 5-226112, and inorganic solids having a high relative dielectric constant such as barium titanate, strontium titanate and potassium niobate as described in JP-A 6-68963.

For withstand voltage improvements, boron carbide as described in JP-A 4-74383 may be added.

For strength improvements, there may be added hydrated alkali titanates as described in JP-A 5-74603, and titanium oxide, iron oxide, zinc oxide and silica as described in JP-A 8-17563.

There may be added a crystal nucleator, for example, alkali halides and melamine resin as described in JP-B 59-10553, benzoic acid, dibenzylidenesorbitol and metal benzoates as described in JP-A 6-76511, talc, zeolite and dibenzylidenesorbitol as described in JP-A 7-6864, and sorbitol derivatives (gelling agents), asphalt and sodium bis(4-t-butylphenyl) phosphate as described in JP-A 7-263127.

As an arc-controlling agent, there may be added alumina and magnesia hydrate as described in JP-B 4-28744, metal hydrates and silicon carbide as described in JP-A 61-250058.

For preventing the harmful effects of metals, there may be added Irganox MD1024 (Ciba-Geigy) as described in JP-A 7-6864, etc.

As a flame retardant, there may be added diantimony trioxide and aluminum hydroxide as described in JP-A 61-239581, magnesium hydroxide as described in JP-A 5-74603, as well as halogen-containing organic compounds (including polymers) such as 2,2-bis(4-hydroxy-3,5-dibromophenyl)propane and polyvinylidene fluoride (PVDF) and phosphorus compounds such as ammonium phosphate.

In addition to these additives, the thermistor of the invention may contain zinc sulfide, basic magnesium carbonate, aluminum oxide, calcium silicate, magnesium silicate, aluminosilicate clay (mica, talc, kaolinite, montmorillonite, etc.), glass powder, glass flakes, glass fibers, calcium sulfate, etc.

The above additives should preferably be used in an amount of up to 25% by weight based on the total weight of the polymer matrix, low-molecular organic compound and conductive particles.

The organic PTC thermistor according to the invention has a low initial resistance in its non-operating state, typically a room-temperature resistivity of about $10^{-2}$ to $10^{0}$ Ω-cm, and experiences a sharp resistance rise during operation so that the rate of resistance change upon transition from its non-operating state to operating state may be 6 orders of magnitude or greater.

EXAMPLE

Examples of the invention are given below by way of illustration and not by way of limitation.

Example 1

There were furnished linear low-density polyethylene synthesized in the presence of a metallocene catalyst by a vapor phase process (trade name Evolue SP2020 by Mitsui Chemical Co., Ltd., MFR 1.5 g/10 min and melting point 117° C.) and filamentary nickel powder (trade name Type 255 Nickel Powder by INCO Ltd., average particle diameter 2.2–2.8 μm, apparent density 0.5–0.659 g/cm$^3$, and specific surface area 0.68 m$^2$/g) as the conductive particles. The linear low-density polyethylene and a 4-fold weight of the nickel powder were mixed in a mill at 135° C. for 20 minutes.

The milled mixture was pressed at 135° C. into a sheet of 1.1 mm thick by means of a heat pressing machine. The sheet on opposite surfaces was sandwiched between a pair of Ni foil electrodes of about 30 μm thick. The assembly was heat pressed at 135° C. to a total thickness of 1 mm by means of a heat press. The sheet was then punched into a disk of 1 cm in diameter, obtaining an organic PTC thermistor device.

FIG. 1 is a cross-sectional view of this thermistor device. As seen from FIG. 1, the thermistor device has a thermistor body 12 in the form of a cured sheet containing the polymer and conductive particles, sandwiched between electrodes 11 of nickel foil.

Figure 2:
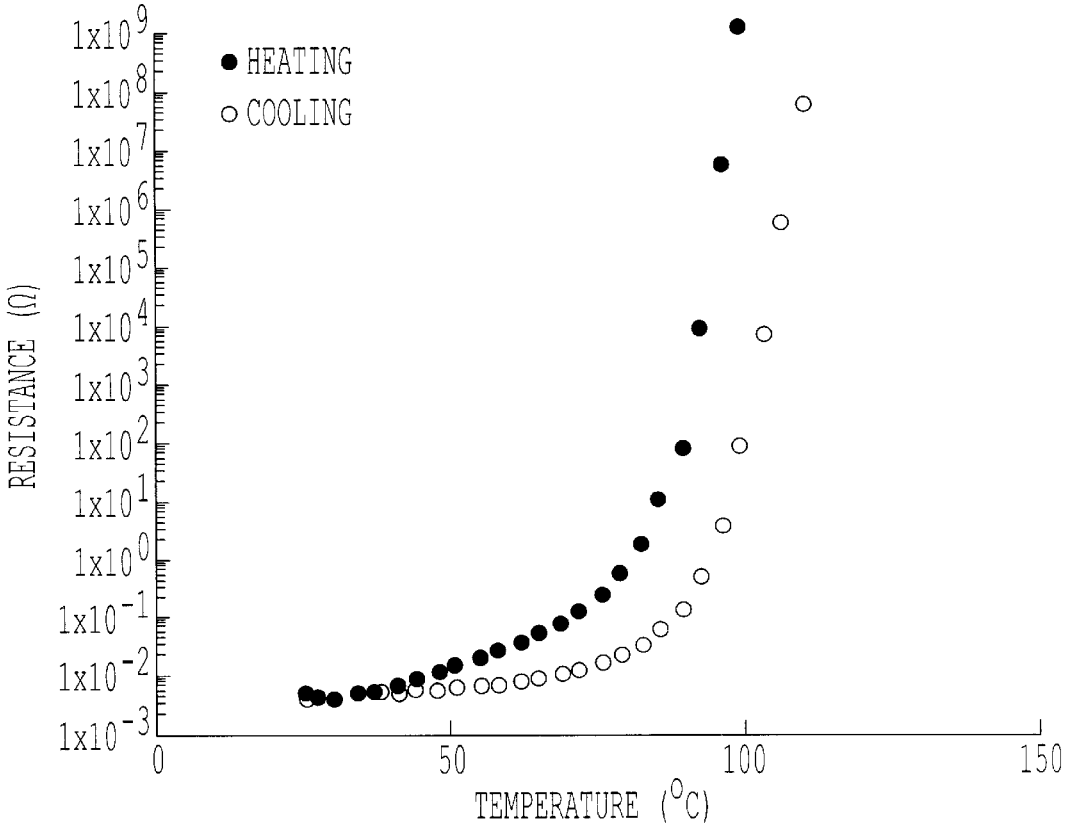
FIG. 2 is a temperature vs. resistance curve of the thermistor of Example 1.

The device was heated and cooled between room temperature (25° C.) and 120° C. at a rate of 2° C./min in a thermostat. A resistance value was measured at predetermined temperatures by the four-terminal method, from which temperature vs. resistance curves were depicted in the graph of FIG. 2.

The initial resistance at room temperature (25° C.) was $4.9\times10^{-3}$ Ω ($3.8\times10^{-2}$ Ω-cm). The resistance marked a sharp rise in proximity to the melting point 100° C., with the resistance change being of at least 11 orders of magnitude. The resistance after cooling to room temperature was $3.6\times10^{-3}$ Ω ($2.8\times10^{-2}$ Ω-cm), which was substantially unchanged from the initial, indicating a satisfactory resistance resuming ability.

Example 2

There were furnished linear low-density polyethylene synthesized in the presence of a metallocene catalyst (trade name Evolue SP2020 by Mitsui Chemical Co., Ltd., MFR 1.5 g/10 min and melting point 117° C.) as the polymer, filamentary nickel powder (trade name Type 255 Nickel Powder by INCO Ltd., average particle diameter 2.2–2.8 μm, apparent density 0.5–0.659 g/cm$^3$, and specific surface area 0.68 m$^2$/g) as the conductive particles, and paraffin wax (trade name HNP-10 by Nippon Seiro Co., Ltd., melting point 75° C.) as the low-molecular weight organic compound. The linear low-density polyethylene and a 4-fold weight of the nickel powder were mixed in a mill at 135° C. for 5 minutes.

Then 66% by weight based on the linear low-density polyethylene of the paraffin wax and a 4-fold weight based on the wax of the nickel powder were added to the mixture. There were further added 0.5% by weight based on the total weight of organic ingredients of a silane coupling agent (vinyltriethoxysilane, trade name KBE1003 by Shin-Etsu Chemical Co., Ltd.) and 20% by weight based on the weight of the silane coupling agent of an organic peroxide (2,2'-di (t-butylperoxy)butane, trade name Trigonox DT50 by Kayaku Akzo Co., Ltd.). Milling was continued for a further 15 minutes.

The milled mixture was pressed at 135° C. into a sheet of 1.1 mm thick by means of a heat pressing machine. The sheet was immersed in a 20 wt % aqueous suspension of dibutyltin dilaurate (by Tokyo Kasei Co., Ltd.) for crosslinking treatment at 65° C. for 8 hours.

The crosslinked sheet was dried in vacuum and sandwiched on its opposite surfaces between a pair of Ni foil electrodes of about 30 $\mu$m thick. The Ni foil was pressed onto the sheet at 150° C. by means of a heat press, resulting in a total thickness of 1 mm. The sheet was then punched into a disk of 1 cm in diameter, obtaining an organic PTC thermistor device.

Figure 3:
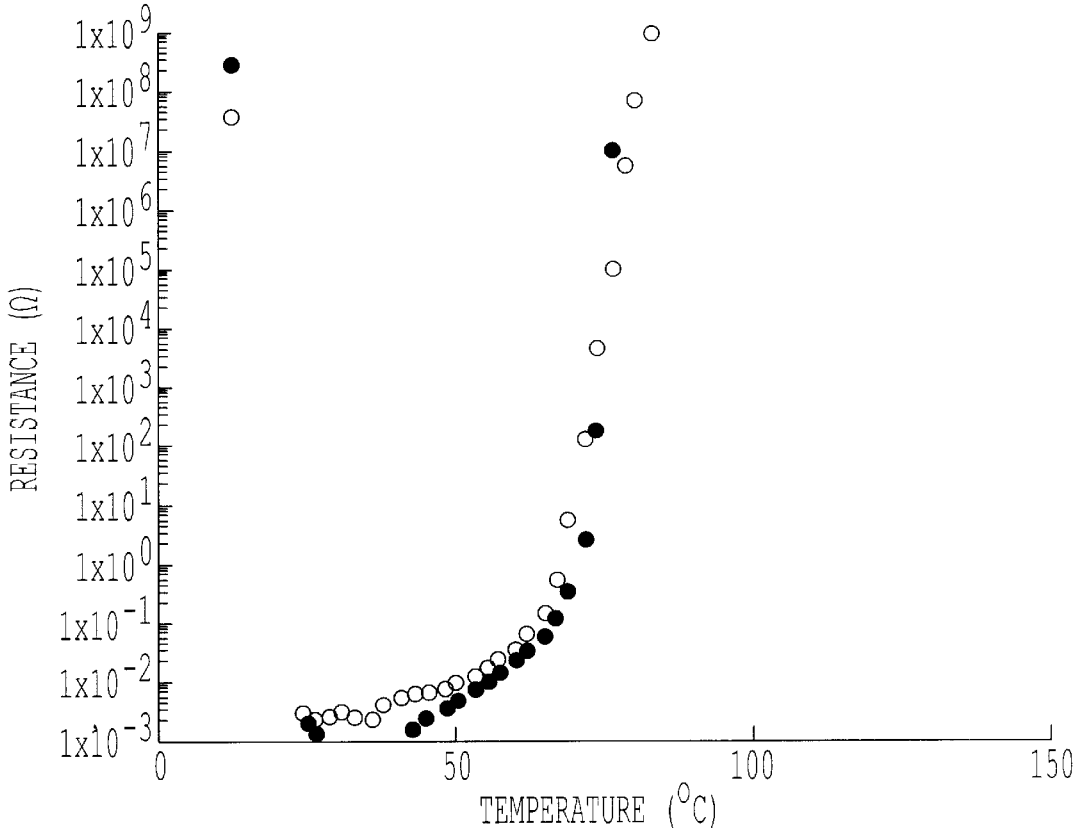
FIG. 3 is a temperature vs. resistance curve of the thermistor of Example 2.

The temperature vs. resistance curves of this device are depicted in the graph of FIG. 3.

The initial resistance at room temperature was $4.2\times10^{-3}$ Ω ($3.3\times10^{-2}$ Ω-cm). The resistance marked a sharp rise in proximity to the melting point of paraffin wax, with the resistance change being of at least 11 orders of magnitude. After the resistance had increased, heating was further continued to 120° C., during which no NTC phenomenon was observed. The temperature vs. resistance curve upon cooling was substantially unchanged from that upon heating, indicating a fully reduced hysteresis. The resistance after cooling to room temperature was $3.6\times10^{-3}$ Ω ($2.8\times10^{-2}$ Ω-cm), which was substantially unchanged from the initial, indicating a satisfactory resistance resuming ability.

An accelerated test was made on the device by holding the device in a thermostat tank set at 80° C. and RH 80%. The room-temperature resistance after 500 hours was $2.3\times10^{-3}$ Ω ($1.8\times10^{-2}$ Ω-cm), indicating little change, and the resistance change was of at least 11 orders of magnitude, demonstrating the maintenance of satisfactory PTC performance. The temperature vs. resistance curves are depicted in FIG. 3. It is evident that no NTC phenomenon after the resistance rise was observed, indicating a little change of profile between heating and cooling. This set of accelerated conditions corresponds to a humidity lifetime of at least 20 years in Tokyo and at least 10 years in Naha (in Okinawa), when calculated in terms of absolute humidity.

Also, the device was subjected to a discontinuous load test by conducting a DC current of 10 A and 5 V to operate it on Joule heat for 10 seconds (ON state) and interrupting the current for 50 seconds (OFF state). The room-temperature resistance was $3.9\times10^{-3}$ Ω ($3.1\times10^{-2}$ Ω-cm), and the resistance change was of at least 11 orders of magnitude, demonstrating the maintenance of satisfactory PTC performance. As in the accelerated test, no NTC phenomenon after the resistance rise was observed, indicating a little change of profile between heating and cooling and a fully reduced hysteresis.

Example 3

An organic thermistor device was fabricated as in Example 2 except that a paraffin wax having a melting point of 66° C. (trade name HNP-3 by Nippon Seiro Co., Ltd.) was used instead of the paraffin wax in Example 2.

The device was measured for temperature vs. resistance as in Example 2. The room-temperature resistance was $3.4\times10^{-3}$ Ω ($2.6\times10^{-2}$ Ω-cm). The resistance marked a sharp rise at 65° C., with the resistance change being of at least 11 orders of magnitude. It was found that the operating temperature could be adjusted in accordance with the melting point of the low-molecular weight organic compound used. Upon further heating after the resistance rise, no NTC phenomenon was observed. The temperature vs. resistance curve remained substantially unchanged between heating and cooling, indicating a fully reduced hysteresis. The resistance after cooling to room temperature was $4.4\times10^{-3}$ Ω ($3.5\times10^{-2}$ Ω-cm), which was substantially unchanged from the initial, indicating a satisfactory resistance resuming ability.

Example 4

An organic thermistor device was fabricated as in Example 2 except that methyl arachidate (Tokyo Kasei Co., Ltd., melting point of 48° C.) was used instead of the paraffin wax in Example 2.

The device was measured for temperature vs. resistance as in Example 2. The room-temperature resistance was $3.9\times10^{-3}$ Ω ($3.1\times10^{-2}$ Ω-cm). The resistance marked a sharp rise at 50° C., with the resistance change being of at least 11 orders of magnitude. Upon further heating after the resistance rise, no NTC phenomenon was observed. The temperature vs. resistance curve remained substantially unchanged between heating and cooling, indicating a fully reduced hysteresis. The resistance after cooling to room temperature was $4.2\times10^{-3}$ Ω ($3.3\times10^{-2}$ Ω-cm), which was substantially unchanged from the initial, indicating a satisfactory resistance resuming ability.

Example 5

An organic thermistor device was fabricated as in Example 2 except that behenic acid (Nippon Seika Co., Ltd., melting point of 81° C.) was used instead of the paraffin wax in Example 2.

The device was measured for temperature vs. resistance as in Example 2. The room-temperature resistance was $3.4\times10^{-3}$ Ω ($2.6\times10^{-2}$ Ω-cm). The resistance marked a sharp rise at 83° C., with the resistance change being of at least 11 orders of magnitude. Upon further heating after the resistance rise, no NTC phenomenon was observed. The temperature vs. resistance curve remained substantially unchanged between heating and cooling, indicating a fully reduced hysteresis. The resistance after cooling to room temperature was $4.1\times10^{-3}$ Ω ($3.2\times10^{-2}$ Ω-cm), which was substantially unchanged from the initial, indicating a satisfactory resistance resuming ability.

Example 6

There were furnished linear low-density polyethylene synthesized in the presence of a metallocene catalyst (trade name Evolue SP2520 by Mitsui Chemical Co., Ltd., MFR 1.7 g/10 min and melting point 121° C.) as the polymer, filamentary nickel powder (trade name Type 210 Nickel Powder by INCO Ltd., average particle diameter 0.5–1.0 $\mu$m, apparent density 0.8 g/cm$^3$, and specific surface area 1.5–2.5 m$^2$/g) as the conductive particles, and paraffin wax (trade name Polywax 655 by Baker Petrolite Co., melting point 99° C.) as the low-molecular weight organic compound. The polyethylene and the paraffin wax in a weight ratio of 1.68:1, and the nickel powder in a 4-fold weight based on the total weight of polyethylene plus paraffin wax were mixed in a mill at 150° C. for 30 minutes.

The milled mixture was sandwiched between Ni foil electrodes and heat pressed at 150° C. to a total thickness of 0.4 mm by means of a heat pressing machine. The electrode-bonded sheet at opposite surfaces was irradiated with electron beams in a dose of 20 MRad for crosslinking treatment. The sheet was punched out as in Example 1, obtaining a thermistor device.

The initial room-temperature resistance was $1.9\times10^{-3}$ Ω. The resistance marked a sharp rise near 85° C., with the resistance change being of at least 11 orders of magnitude. Upon further heating after the resistance rise, no NTC phenomenon was observed, and the hysteresis was fully minimized. The resistance after cooling to room temperature was $1.6\times10^{-3}$ Ω, which was substantially unchanged from the initial, indicating a satisfactory resistance resuming ability.

Comparative Example 1

A thermistor device was fabricated as in Example 1 except that a high density polyethylene (trade name HY540 by Nippon Polychem Co., Ltd., MFR 1.0 g/10 min and melting point 135° C.) was used as the polymer.

As in Example 1, the device was measured for temperature vs. resistance over cycles of room temperature to 150° C. to room temperature. The initial room-temperature resistance was $5.5\times10^{-3}$ Ω ($4.3\times10^{-2}$ Ω-cm) and the resistance change was of at least 11 orders of magnitude, but the operating temperature was as high as 130° C. or above.

Comparative Example 2

An organic thermistor device was fabricated as in Comparative Example 1 except that the high density polyethylene used in Comparative Example 1 was replaced by a low density polyethylene (trade name LC500 by Nippon Polychem Co., Ltd., MFR 4.0 g/10 min and melting point 106° C.).

The room-temperature resistance was $1.2\times10^{-1}$ Ω ($9.4\times10^{-2}$ Ω-cm), the operating temperature was 85° C., and the resistance change was of at least 9 orders of magnitude. However, the resistance after cooling to room temperature was 1.69 Ω (13.3 Ω-cm), which was an increase of at least 1 order of magnitude from the initial, indicating a very poor resistance resuming ability.

Comparative Example 3

A thermistor device was fabricated as in Example 2 except that the linear low-density polyethylene used in Example 2 was replaced by a high-density polyethylene (trade name HY540 by Nippon Polychem Co., Ltd., MFR 1.0 g/10 min and melting point 135° C.). The high-density polyethylene and a 4-fold weight of the nickel powder were mixed in a mill at 135° C. for 5 minutes, following which the paraffin wax in a 1.5-fold weight based on the high-density polyethylene and the nickel powder in a 4-fold weight based on the wax were added.

The room-temperature resistance was $2.9\times10^{-3}$ Ω ($2.3\times10^{-2}$ Ω-cm), the resistance marked a sharp rise near the melting point 75° C. of paraffin wax, and the resistance change was of at least 11 orders of magnitude. However, upon further heating to 120° C. after the resistance rise, a NTC phenomenon incurring a substantial decline of resistance was observed.

Upon cooling, the resistance started to decline at about 115° C. which was 40° C. higher than the operating temperature of 75° C. upon heating, indicating a large hysteresis. The resistance after cooling to room temperature was $4.1\times10^{-3}$ Ω ($3.2\times10^{-2}$ Ω-cm), which was substantially unchanged from the initial, indicating a good resistance resuming ability.

Comparative Example 4

A thermistor device was fabricated as in Comparative Example 3 except that the high-density polyethylene used in Comparative Example 3 was replaced by a low-density polyethylene (trade name LC500 by Nippon Polychem Co., Ltd., MFR 4.0 g/10 min and melting point 106° C.).

The room-temperature resistance was $3.0\times10^{-3}$ Ω ($2.4\times10^{-2}$ Ω-cm), the resistance marked a sharp rise near 75° C., and the resistance change was of at least 11 orders of magnitude. The temperature vs. resistance curve was substantially the same between heating and cooling, indicating little hysteresis. Moreover little NTC phenomenon was observed. However, the resistance after cooling to room temperature was $2.5\times10^{-2}$ Ω ($2.0\times10^{-1}$ Ω-cm), which was an increase of slightly less than 1 order of magnitude. An outstanding increase of room-temperature resistance was observed in the accelerated test, marking a resistance of $7.0\times10^{-1}$ Ω (5.5 Ω-cm) after 100 hours of holding at 80° C. and RH 80%. The performance was considerably inferior as compared with Example 2.

BENEFITS OF THE INVENTION

As described above, an organic PTC thermistor having a lower operating temperature than prior art organic PTC thermistors and exhibiting improved characteristics is established according to the invention.

What is claimed is:

1. An organic positive temperature coefficient thermistor comprising:

a polymer synthesized in the presence of a metallocene catalyst; and conductive particles having spiky protuberances.

2. The organic positive temperature coefficient thermistor of claim 1, wherein said polymer synthesized in the presence of a metallocene catalyst is a linear low-density polyethylene.

3. The organic positive temperature coefficient thermistor of claim 1, wherein said conductive particles having spiky protuberances are interconnected in chain-like network.

4. The organic positive temperature coefficient thermistor of claim 1, further comprising a low molecular weight organic compound.

5. A method for preparing an organic positive temperature coefficient thermistor, comprising the steps of synthesizing a polymer in the presence of a metallocene catalyst, admixing the polymer with conductive particles having spiky protuberances, and treating the mixture with a silane coupling agent.

* * * * *